US005667297A

United States Patent [19]

Maassen

[11] Patent Number: 5,667,297

[45] Date of Patent: Sep. 16, 1997

[54] ELECTRIC REFLECTOR LAMP

[75] Inventor: Egbertus J. P. Maassen, Eindhoven, Netherlands

[73] Assignee: U.S. Philips Corporation, New York, N.Y.

[21] Appl. No.: 517,154

[22] Filed: Aug. 21, 1995

[30] Foreign Application Priority Data

Aug. 29, 1994 [EP] European Pat. Off. ..... 94202459
Mar. 8, 1995 [EP] European Pat. Off. ..... 95200563

[51] Int. Cl.[6] ..... F21V 7/06; H01J 5/02

[52] U.S. Cl. ..... 362/297; 362/263; 362/346

[58] Field of Search ..... 362/297, 346, 362/350, 304, 263

[56] References Cited

U.S. PATENT DOCUMENTS 1,726,379 8/1929 Benford .
2,194,431 3/1940 O'Neil ..... 362/297
3,329,812 7/1967 Harling ..... 362/263
4,310,772 1/1982 Tyler et al. .
4,494,176 1/1985 Sands et al. ..... 362/297
4,545,000 10/1985 Fraley et al. ..... 362/297

FOREIGN PATENT DOCUMENTS 543448 5/1993 European Pat. Off. .

*Primary Examiner*—Stephen F. Husar
*Assistant Examiner*—Sara Sachie Raab
*Attorney, Agent, or Firm*—Walter M. Egbert, III

[57] ABSTRACT

The electric reflector lamp has a reflector body with a light-beam shaping surface which comprises a body of revolution of a branch of a parabola which has been tilted towards the optical axis of the light-beam shaping surface. The light-beam shaping surface has superimposed plane axial lanes of which the number in a first zone remote from the light emission window is half that in a second zone adjacent said window. The axial lanes give the light-beam shaping surface cross-sections which are regular polygons. A light source is positioned on the optical axis, while the focus is inside this light source. The lamp has a universal burning position, a good mixing of the generated light, and a comparatively high luminous flux in the beam.

10 Claims, 2 Drawing Sheets

ELECTRIC REFLECTOR LAMP

BACKGROUND OF THE INVENTION

The invention relates to an electric reflector lamp provided with

- a reflector body with a concave light-beam shaping surface having an optical axis, which reflector body has a light emission window which is closed off with a light-transmitting cover,
- a light source on the optical axis, accommodated in a lamp vessel which is closed in a gastight manner,
- a lamp cap provided with contacts and connected to the reflector body, current conductors which connect the light source to respective contacts of the lamp cap,
- the light-beam shaping surface being subdivided into axial lanes.

Such an electric reflector lamp is known from EP-A 0 543 448 (PHN 13.900).

The known reflector lamp may have electrodes in an ionizable filling or an incandescent body as its light source.

The known lamp was found to yield a light beam in which differences in brightness between portions of the incandescent body become evident in the presence of an incandescent body as the light source, so that the beam is inhomogeneous. With a discharge arc between electrodes in an ionizable filling, differences in brightness may also arise in the beam, for example owing to a current conductor which extends alongside the discharge arc. With a high-pressure metal halide discharge, the lamp provides an illuminated field in which colour differences occur. When the lamp radiates predominantly upwards, the colour pattern is different from the pattern when it radiates predominantly downwards. The shape of the generated light beam, in addition, strongly depends on the position occupied by the discharge are in the reflector body.

SUMMARY OF THE INVENTION

It is an object of the invention to provide a reflector lamp of the kind described in the opening paragraph in which inhomogeneities in the light beam formed are avoided and whose light beam moreover shows little dependence on the position of the light source in the reflector body, while still yielding a comparatively narrow beam.

According to the invention, this object is achieved in that the light-beam shaping surface has the body of revolution around the optical axis of a branch of a parabola which has been tilted towards the optical axis and whose focus lies on the optical axis inside the light source, the axial lanes being superimposed on said surface,

- the axial lanes are plane transverse to their axial direction and give the light-beam shaping surface cross-sections transverse to the optical axis which are regular polygons,
- a first zone remote from the light emission window has half the number of axial lanes which a second zone adjacent the light emission window has.

The measures taken in the reflector lamp according to the invention result in an effective beam concentration and mixing of the light generated by the light source. As a result, a light beam with a comparatively high luminous flux and a high degree of homogeneity is obtained. The reflector lamp with a discharge are yields a beam with a high colour uniformity, also when it is operated in a random position. The properties of the light beam of the reflector lamp show little dependence on the position of the light source in the reflector body in directions transverse to the axis thereof, so that the light source has a wide mounting tolerance. Also a position of the light source which has been tilted through up to a few degrees relative to the optical axis has little or no adverse effect on the beam formed, as long as the focus remains inside the light source.

To obtain a comparatively high brightness in the centre of a field illuminated by the reflector lamp, as well as a sharp demarcation of the illuminated field, it is favourable to give the light source a slight displacement over the optical axis towards the lamp cap. The focus then still lies in the light source, but outside the centre thereof. Depending on the size of the reflector body and the heat generated by the light source, the lamp temperature may rise locally, such as near the lamp cap, to a comparatively high value.

To avoid this, in a favourable embodiment, the first zone of the light-beam shaping surface is paraboloidally curved and its focus substantially coincides with the focus of the second zone. The first, paraboloidally curved zone then mainly illuminates the central region of the field covered by the lamp, while the second zone curved along a revolved, tilted parabola branch mainly throws light on a region around the centre. Both zones, however, also contribute to the illumination of the other region, so that mixing of fight is maintained. The light source may be comparatively far removed from the lamp cap in this embodiment, so that comparatively high temperatures in the first zone are counteracted.

The lamp vessel of the reflector lamp may be made of glass, for example of quartz glass, or alternatively of hard glass with an incandescent body acting as the light source, or of a ceramic material, for example mono- or polycrystalline aluminum oxide. If so desired, for example in the case of a ceramic lamp vessel, it may be accommodated in an envelope, for example one which is closed in a gastight manner, and for example made of quartz glass, such as for example if the space within the reflector body is not evacuated or filled with an inert gas.

The reflector body and the cover may be moulded from glass, but may alternatively be made from, for example, a synthetic resin. The reflector body may alternatively be made from metal. The light-beam shaping surface in the latter case may be obtained, for example, through polishing, or in the case of aluminum, through anodizing. The light-beam shaping surface may be obtained through deposition of a metal film, for example by vapour deposition, for example an aluminum, silver, or gold film. Alternatively, a reflecting interference film may be provided, built up from alternating layers of high and low refractive index such as, for example, of niobium oxide, tantalum oxide, silicon nitride, etc., and silicon oxide, respectively.

The cover may be formed as a lens, for example a prismatic lens. In that case the cover has, for example, prismatic rings at its inner surface. An otherwise narrow beam of approximately 10° may then be widened to, for example, approximately 30°.

It is favourable when the second zone having the greater number of axial lanes extends entirely between the light emission window and a plane perpendicular to the optical axis and through the focus. In particular, the second zone extends up to locations which enclose an angle $\alpha$ of 80±5° with the optical axis, measured from the focus. The first zone completes the light-beam shaping surface.

The reflector lamp according to the invention provides a welcome solution especially where the light source is formed by electrodes in an ionizable filling containing metal halides because of the unpleasant colour differences in the beam which occur with conventional reflector lamps having such light sources. The axial dimension of the light source may be, for example, approximately 5 to 10 mm, also depending on its type and envelope. Alternatively, the lamp is useful with an incandescent body, for example in a gas containing halogen, as the light source. Such an incandescent body may be, for example, a linear cylindrical body with an axial dimension of, for example, 3.5 mm in the case of a low-voltage lamp, or have an M-shape of, for example, 6 mm axial length in the case of a mains voltage lamp.

BRIEF DESCRIPTION OF THE DRAWINGS

An embodiment of the reflector lamp according to the invention is shown in the drawing, in which.

DESCRIPTION OF THE PREFERRED EMBODIMENTS

Figure 1:
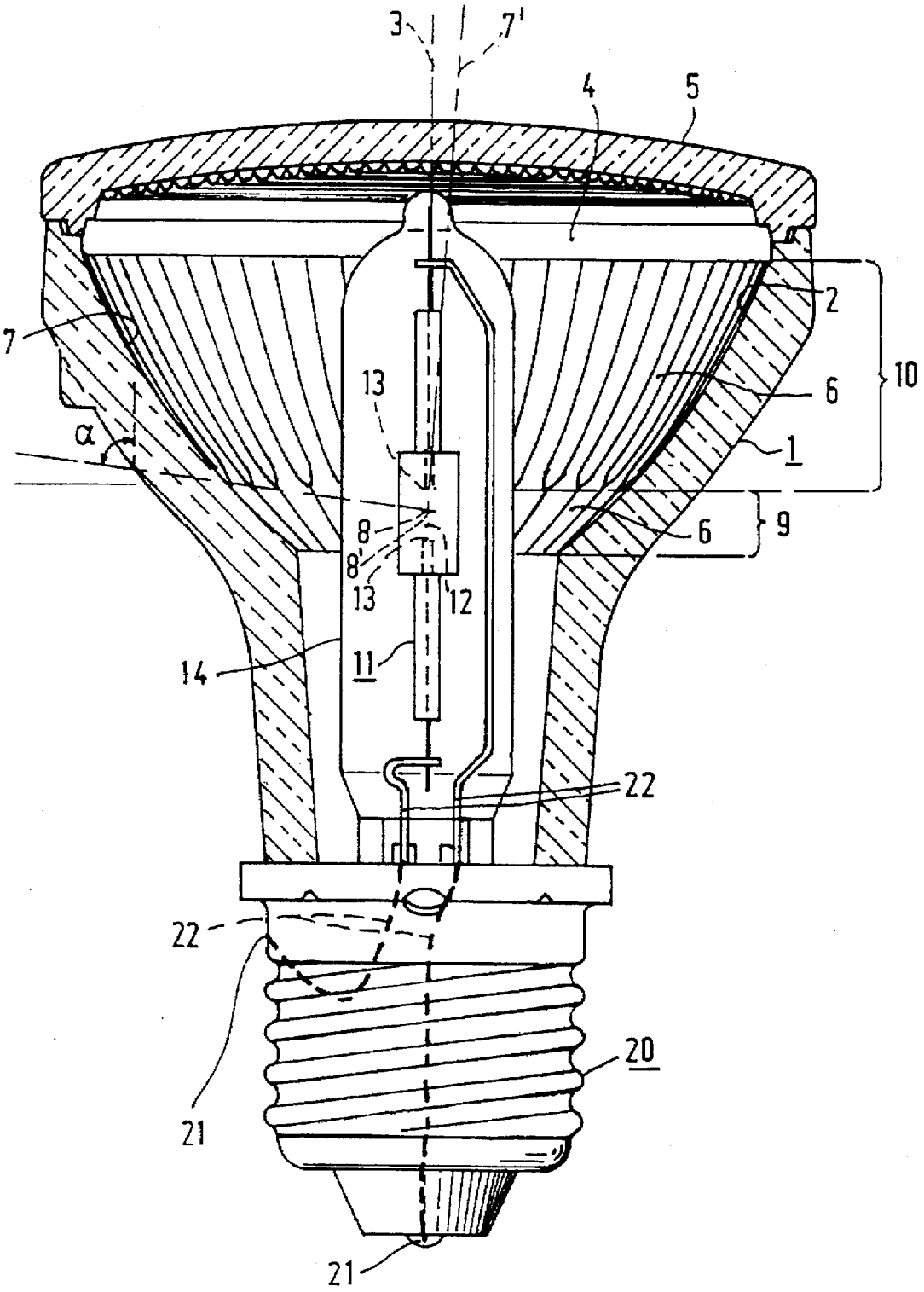
FIG. 1 shows a lamp partly in axial section, partly in side elevation.

The electric reflector lamp of FIG. 1 is provided with a reflector body 1 with a concave light-beam shaping surface 2 having an optical axis 3. The reflector body has a light emission window 4 which is closed with a light-transmitting cover 5. A light source 13, electrodes in an ionizable gas with a discharge path 12 in between in the Figure, is arranged on the optical axis, accommodated in a lamp vessel 11 which is closed in a gaslight manner and which is made of polycrystalline aluminium oxide in FIG. 1. A lamp cap 20 with contacts 21 is connected to the reflector body 1. Current conductors 22 connect the light source 13 to respective contacts 21 of the lamp cap 20. The light-beam shaping surface 2 is subdivided into axial lanes 6.

The light-beam shaping surface 2 has the body of revolution about the optical axis 3 of a branch 7 of a parabola which has been tilted towards the optical axis 3 and whose focus 8 lies on the optical axis inside the light source 13, between the electrodes. The axis of the parabola branch 7 is referenced 7' in FIG. 1. This axis encloses an angle of a few, for example 3 to 6, degrees with the optical axis 3. The axial lanes 6 are superimposed on said surface. The axial lanes 6 are planar in a direction transverse to their axial direction and give the light-beam shaping surface 2 cross-sections transverse to the optical axis 3 which are regular polygons.

In the lamp drawn, the first zone 9 of the light-beam shaping surface 2 is paraboloidally curved, and its focus 8' substantially coincides with the focus 8 of the second zone 10.

Figure 2:
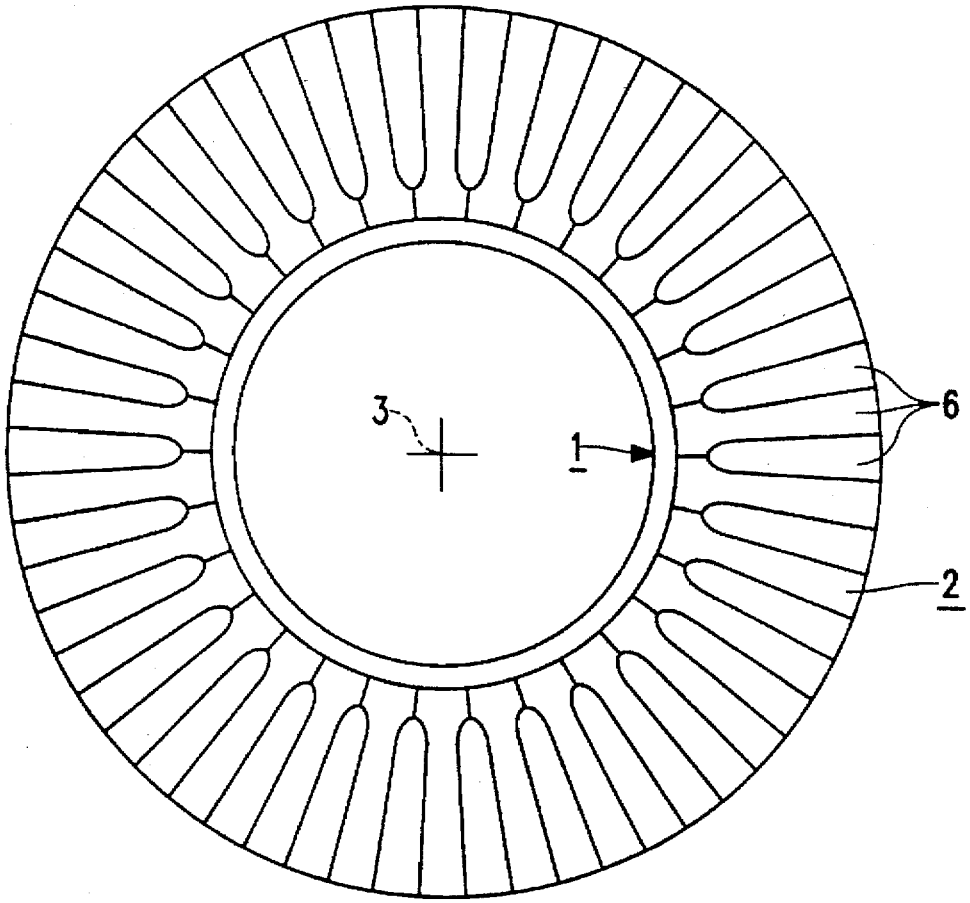
FIG. 2 is the axial elevation of the light-beam shaping surface of FIG. 1.

It is evident from FIG. 2 that, when the light-beam shaping surface is intersected by a plane transverse to the optical axis 3, for example adjacent its greatest or its smallest width, the lanes which are planar transversely to their axial direction give the cross-sections a regular polygonal shape. Similar cross-sections are obtained elsewhere with the exception of the small transitional area where the number of lanes changes.

A first zone 9 (FIG. 1) remote from the light emission window 4 has half the number of axial lanes, i.e. 30 in the Figure, of a second zone 10 adjacent the light emission window, which has 60 lanes. The number of lanes in the first zone, however, may be chosen to be greater or smaller.

The second zone 10 extends completely between the light emission window 4 and a plane perpendicular to the optical axis 3 and through the focus 8, in FIG. 1 up to locations which enclose an angle $\alpha$ of 80±5° with the optical axis, measured from the focus 8.

The ionizable filling of the discharge vessel 11 comprises rare gas and metal halides, for example sodium, thallium, and dysprosium halides. A high-pressure discharge is maintained therein during operation.

The cover 5 is a lens with a prismatic inner surface.

In FIG. 1, the lamp vessel 11 is arranged in a gastight quartz glass envelope 14.

The lamp shown has a light emission window of approximately 6.5 cm, consumes a power of 35 W during operation, and yields approximately 3400 lm. The reflector lamp generates a light beam which is independent of the burning position and homogeneous in colour, and which has a width of 30° and a luminous intensity of 7 kcd in the centre of the beam. The current conductor 22 which runs alongside the lamp vessel has no observable influence on the beam. When an optically inactive cover is used, the beam width is 10° and the luminous intensity in the centre approximately 33 kcd. The beam formed shows little dependence on the location of the focus inside the light source in directions transverse to the axis 3.

Figure 3:
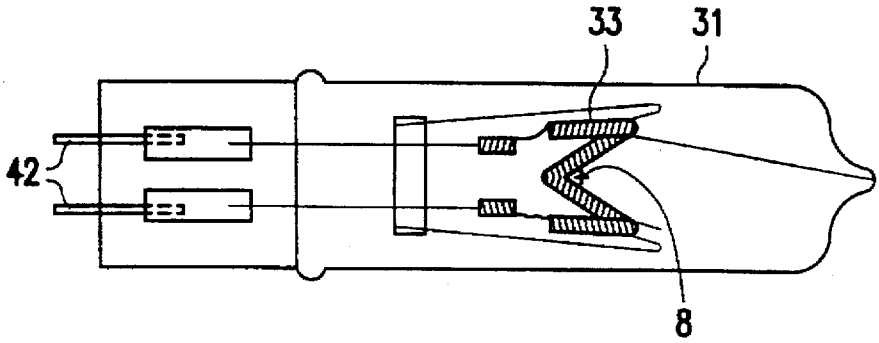
FIG. 3 is a burner for an embodiment different from that in FIG. 1 in side elevation.

In FIG. 3, the burner has an incandescent body as its light source 33 in the shape of an M in the elevation shown, accommodated in a glass lamp vessel 31 from which current conductors 42 issue to the exterior, capable of connecting the light source to respective contacts of the lamp cap of a lamp. The burner may be accommodated in the reflector body of FIG. 1 or in a modification thereof, where the light-beam shaping surface entirely consists of the body of revolution of a tilted parabola branch. The focus 8 thereof will be positioned inside the light source. The light source consumes a power of 75 W when operated on mains voltage. The lamp vessel has a filling of rare gas and hydrogen bromide. Inhomogeneities are avoided in the beam formed by the reflector lamp having this burner. The location of the focus within the light source in directions perpendicular to the axis 3 is found to be of little influence.

I claim:

1. An electric reflector lamp comprising a reflector body with a concave light-beam shaping surface having an optical axis, which reflector body has a light emission window which is closed off with a light-transmitting cover, a light source on the optical axis, accommodated in a lamp vessel which is closed in a gaslight manner, a lamp cap provided with contacts and connected to the reflector body, current conductors which connect the light source to respective contacts of the lamp cap, the light-beam shaping surface being subdivided into axial lanes, characterized in that the light-beam shaping surface is a body of revolution around the optical,axis of a branch of a parabola which has been tilted towards the optical axis and whose focus lies on the optical axis inside the light source, the axial lanes being superimposed on said surface, the axial lanes are planar transverse to the axial direction and give the light-beam shaping surface cross-sections transverse to the optical axis which are regular polygons, a first zone remote from the light emission window has half the number of axial lanes which a second zone adjacent the light emission window has.

2. An electric reflector lamp as claimed in claim 1, characterized in that the first zone is paraboloidally curved and has a focus which coincides substantially with a focus of the second zone.

3. An electric reflector lamp as claimed in claim 2, characterized in that the second zone -extends entirely between the light emission window and a planar perpendicular to the optical axis and through the focus of the second zone.

4. An electric reflector lamp as claimed in claim 3, characterized in that the second zone extends up to locations which enclose an angle $\alpha$ of 80±5° with the optical axis, measured from the focus of the second zone.

5. An electric reflector lamp as claimed in claim 2, characterized in that the light source is formed by electrodes in an ionizable filling containing metal halides.

6. An electric reflector lamp as claimed in claim 2, characterized in that the cover is a lens.

7. An electric reflector lamp as claimed in claim 1, characterized in that the cover is a lens.

8. An electric reflector lamp as claimed in claim 1, characterized in that the light source is formed by electrodes in an ionizable filling containing metal halides.

9. An electric reflector lamp as claimed in claim 1, characterized in that the second zone extends entirely between the light emission window and a planar perpendicular to the optical axis and through a focus of the second zone.

10. An electric reflector lamp as claimed in claim 9, characterized in that the second zone extends up to locations which enclose an angle $\alpha$ of 80±5° with the optical axis, measured from the focus of the second zone.

* * * * *